US007774102B2

(12) United States Patent
Butler et al.

(10) Patent No.: US 7,774,102 B2
(45) Date of Patent: Aug. 10, 2010

(54) SYSTEM INCLUDING INTERACTIVE CONTROLLERS FOR CONTROLLING OPERATION OF CLIMATE CONTROL SYSTEM

(75) Inventors: William P. Butler, St. Louis, MO (US); James P. Garozzo, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 199 days.

(21) Appl. No.: 12/107,747

(22) Filed: Apr. 22, 2008

(65) Prior Publication Data

US 2009/0261174 A1 Oct. 22, 2009

Related U.S. Application Data

(60) Provisional application No. 60/945,779, filed on Jun. 22, 2007.

(51) Int. Cl.

| | |
|---|---|
| ***G05B 13/00*** | (2006.01) |
| ***G05B 15/00*** | (2006.01) |
| ***G05D 23/12*** | (2006.01) |
| ***G05D 23/185*** | (2006.01) |
| ***F24F 11/53*** | (2006.01) |

(52) U.S. Cl. ..... 700/276; 700/277; 236/1 C; 62/181

(58) Field of Classification Search ..... 700/276, 700/277; 236/1 C; 62/181

See application file for complete search history.

(56) References Cited

U.S. PATENT DOCUMENTS

| | | | | |
|---|---|---|---|---|
| 5,058,388 | A * | 10/1991 | Shaw et al. | 62/93 |
| 5,265,436 | A * | 11/1993 | Murata et al. | 62/175 |
| 5,675,830 | A * | 10/1997 | Satula | 710/9 |
| 5,706,190 | A * | 1/1998 | Russ et al. | 700/9 |
| 5,927,398 | A * | 7/1999 | Maciulewicz | 165/209 |
| 6,353,775 | B1 * | 3/2002 | Nichols | 700/276 |
| 7,296,426 | B2 | 11/2007 | Butler et al. | |
| 2003/0097482 | A1 * | 5/2003 | DeHart et al. | 709/253 |
| 2004/0111500 | A1 * | 6/2004 | Rayburn | 709/222 |

* cited by examiner

*Primary Examiner*—Albert DeCady
*Assistant Examiner*—Martti Kontkanen
(74) *Attorney, Agent, or Firm*—Harness, Dickey & Pierce, P.L.C.

(57) ABSTRACT

The present disclosure describes an HVAC system and means for communication between an integrated system of individual controllers for interactively controlling various components in the HVAC system. Various embodiments of an HVAC system are provided that may comprise at least two controllers that communicate with each other to provide a method of controlling the operation of an HVAC system, based on a communication protocol utilized by each of the various controllers. The communication protocol provides for establishing communication between a sending controller and at least one other controller that is the intended recipient. The communication protocol also provides for monitoring of communication signals by one or more controllers in the system, where the one or more controllers monitor communication signals which are intended for other recipient controllers to thereby listen to information being communicated.

1 Claim, 2 Drawing Sheets

SYSTEM INCLUDING INTERACTIVE CONTROLLERS FOR CONTROLLING OPERATION OF CLIMATE CONTROL SYSTEM

CROSS-REFERENCE TO RELATED APPLICATIONS

This application claims the benefit of U.S. Provisional Patent Application No. 60/945,779, filed Jun. 22, 2007, the disclosure of which is incorporated herein by reference.

FIELD OF THE INVENTION

The present invention relates to controllers for monitoring and controlling components within an HVAC system, and more particularly to communication between an integrated system of individual controllers for interactively controlling various components in the HVAC system.

BACKGROUND OF THE INVENTION

Many present HVAC systems employ a plurality of controllers for communicating information within a master/slave network, in which a "master" thermostat or similar central controller is the master that coordinates communication between the various slave components within the HVAC system. Such networks require various subordinate controllers to be configured for communication with and control by a master thermostat or communication controller, without which the system's subordinate controllers can not communicate to operate various components of the HVAC system. Thus, the various HVAC component controllers rely on the master controller to communicate operating instructions and system diagnostics, and each controller does not independently manage its operation based on diagnostic information transmitted by other subordinate HVAC controllers.

SUMMARY OF THE INVENTION

The present disclosure describes an HVAC system and means for communication between an integrated system of individual controllers for interactively controlling various components in the HVAC system. The interactive system comprises various controllers including a thermostat controller for initiating and discontinuing the operation of the HVAC system, where the HVAC system may be capable of operating in either a full capacity mode of operation or at least one reduced capacity mode of operation. The interactive system may also comprise a number of controllers for controlling the operation of an outside condenser unit having a condenser fan motor and a compressor motor, an indoor blower, which is capable of operating a blower fan motor in a full capacity mode and in at least one reduced capacity mode, and a furnace that is capable of operating at a high stage heating mode and in at least one low stage heating mode. Various embodiments of an HVAC system are provided that may comprise at least two controllers that communicate with each other to provide a method of controlling the operation of an HVAC system, based on a communication protocol utilized by each of the various controllers. The communication protocol provides for establishing communication between a sending controller and at least one other controller that is the intended recipient. The communication protocol also provides for monitoring of communication signals by one or more controllers in the system, where the one or more controllers monitor communication signals which are intended for other recipient controllers to thereby listen to information being communicated.

In another aspect of the present disclosure, some embodiments of an HVAC system are provided that have a number of controllers capable of detecting information communicated to at least one other controller, where one or more controllers are configured to responsively controlling the operation of one or more components based on communicated information monitored by each controller. These and other features and advantages will be in part apparent, and in part pointed out hereinafter.

DETAILED DESCRIPTION OF THE EMBODIMENTS

Various embodiments of interactive systems are provided that include a plurality of interactive controllers for controlling the operation of a climate control system. The various embodiments of an HVAC system provide for communication between an integrated system of individual controllers for interactively controlling various components in the HVAC system. The interactive system comprises various controllers including a thermostat controller for initiating and discontinuing the operation of the HVAC system, in either a full capacity mode of operation or at least one reduced capacity mode of operation. The interactive system may also comprise a controller for an outside condenser unit having a condenser fan motor and a compressor motor, which controller is capable of operating the compressor in a full capacity mode and at least one reduced capacity mode. The system also comprises a controller for an indoor blower, which is capable of operating a blower fan motor in a full capacity mode and in at least one reduced capacity mode. The system may also comprise a controller for a furnace unit, which is capable of operating at a high stage heating mode and in at least one low stage heating mode.

The interactive system further includes a communication means for transmitting information between the outside condenser unit controller and the indoor blower controller relating to the operation of the condenser unit components and the blower components. The indoor blower and the condenser unit controllers respectively control operation of the blower fan motor and the compressor in a full capacity mode or a reduced capacity mode based on the information communicated between the controllers. Similarly, the furnace controller and the blower motor controller may also control operation of the furnace and blower fan motor in a high-stage heat or full capacity mode or a low-stage heat or reduced capacity mode based on the information communicated between the controllers. The various controllers are also configured to communicate to a thermostat controller, and may control operation of one or more components of the HVAC system based on information communicated by the thermostat controller or the various other controllers in the system.

Figure 1:
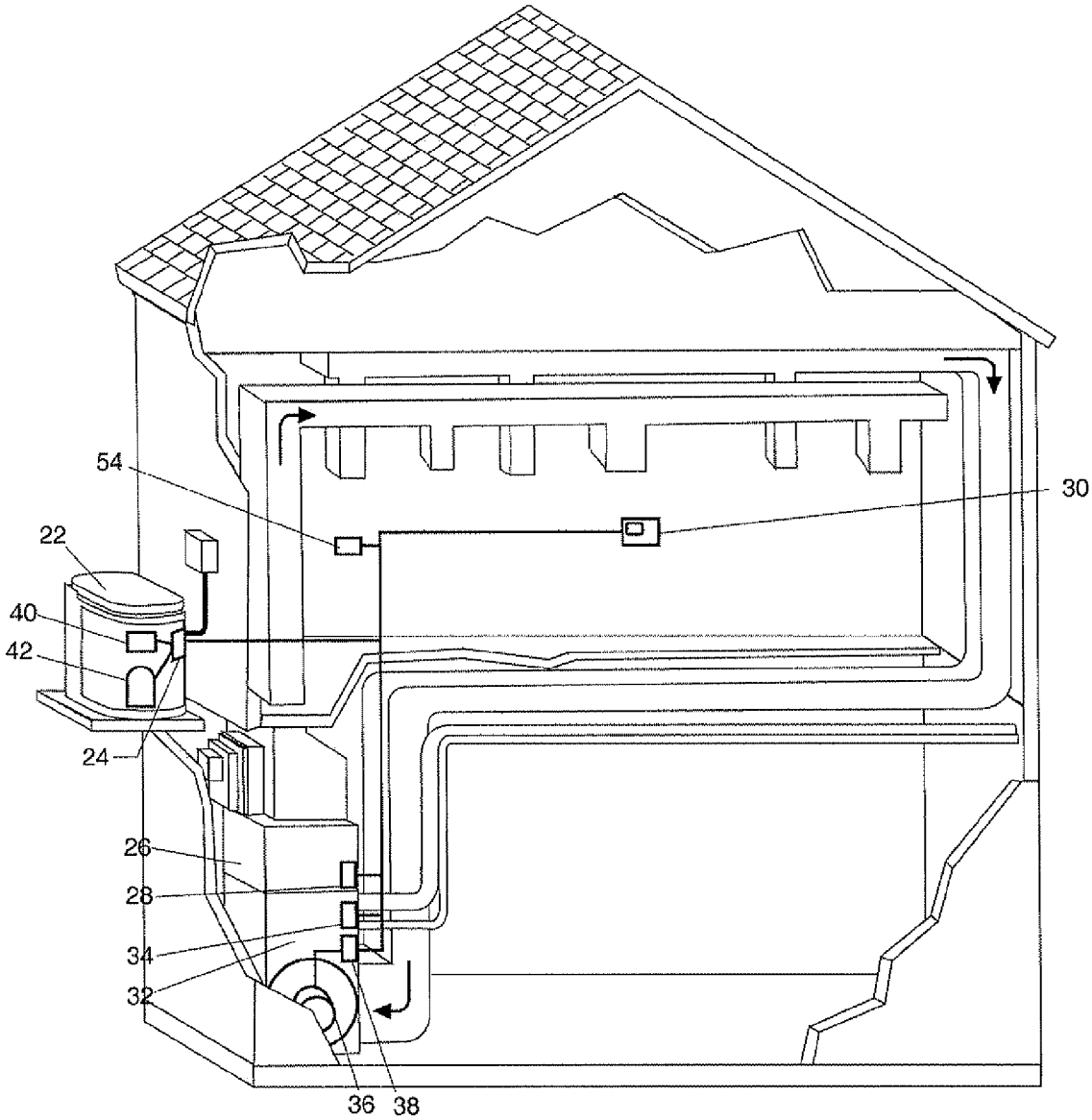
FIG. 1 is an illustration of a building with one embodiment of an interactive control system for an HVAC system according to the principles of the present invention.

One example of a climate control system is shown in FIG. 1, which preferably includes at least one air conditioner comprising an outdoor condenser unit 22. In one embodiment of an interactive system, the climate control system has a controller 24 for the outdoor air conditioner unit, at least one indoor blower unit 26 having an indoor blower controller 28 and at least one thermostat 30 for directing the operation of the various units. The climate control system may further comprise a heating unit 32, such as an electric or gas-fired furnace, and a related furnace controller 34. The climate control system preferably comprises a air circulator blower unit 26 having a blower motor 36. The circulator blower motor 36 may optionally comprise a blower motor controller 38. The thermostat 30 is capable of sensing the temperature within the space, via remote temperature sensor 54 as shown in FIG. 1 and responsively initiating operation of an air conditioning or furnace unit when the sensed temperature is more than a predetermined amount above or below a set point temperature of the thermostat 30. In response to a thermostat signal request for cooling, the outdoor unit controller 24 will control the switching of power to both a condenser fan motor 40 and a compressor motor 42, and the indoor blower controller 28 controls the blower motor 36 or the blower motor controller 38 to provide for air conditioning operation. Likewise, when the thermostat 30 signals a request for heating, the furnace controller 34 controls the activation of the furnace 32 and the blower motor controller 38 controls the blower motor 36 or the blower motor controller 38 to provide for heating operation. Each of the various controllers may be connected to either a high voltage power source or a low voltage power source. The outdoor unit controller 24 may be configured to control a multi-capacity compressor motor 42 as well as a variable speed condenser fan motor 40. Likewise, the indoor air handler/blower controller 28 and the furnace controller 34 may be configured to establish multiple operating speeds of the circulator blower motor 36. The optional blower motor controller 38 may also comprise an integral inverter driver for enabling variable speed control of the blower motor.

Figure 2:
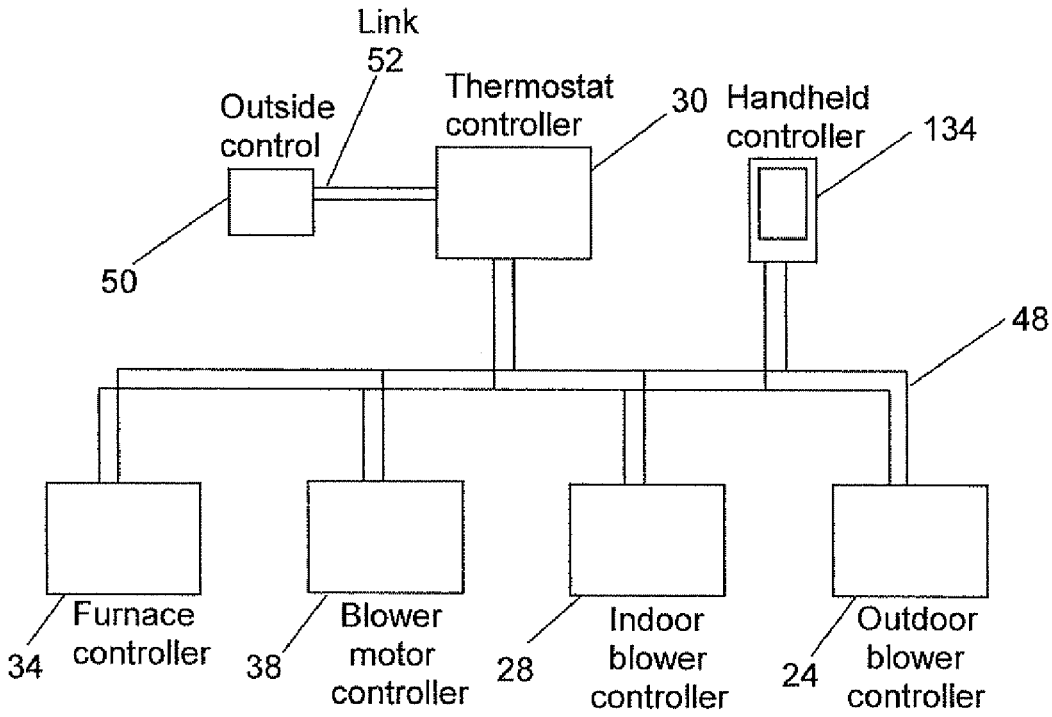
FIG. 2 is a functional block diagram of one embodiment of an interactive system for controlling an HVAC system; and Corresponding reference numerals indicate corresponding parts throughout the several views of the drawings.

In the various embodiments of an interactive system, the various controllers that control individual components within the climate control system are further capable of receiving communication from other controller and components, to interactively control and improve the operation of the climate control system. An interactive thermostat that is connected to the communication network 48 may send a cooling request signal via the network 48, rather than through the conventional 24 volt wire connections to the indoor blower unit controller 28 and outdoor unit controller 24. One communication means that may be employed by the various embodiments is shown in FIG. 2. The communication means comprises a two-wire peer-to-peer network 48, such as an RS-485 peer-to-peer Local Area Network, but may alternatively comprise any other comparable network suitable for use in a peer-to-peer arrangement. An RS-485 network is a two-wire, multi-drop network that allows multiple units to share the same two wires in sending and receiving information. The two-wire network 48 connects to a transmitter and receiver of each controller in the HVAC system (up to 32 controller units), including furnace controller 34, blower motor controller 38, indoor blower controller 28, outdoor unit controller 24, and thermostat controller 30. FIG. 2 also shows a handheld controller 134, and a link 52 to a control at an outside location 50. The controllers may be configured to always be in the receiver mode, monitoring the network 48 for information. Only one transmitter can communicate or occupy the network 48 at a time, so each individual controller may be configured at the time of manufacture to transmit at a fixed time period after the last transmission, where each controller has a time period that is unique to that controller. Thus, after one controller completes its transmission, another controller will wait for the prescribed time period before transmitting its information. In this manner, collisions of data transmission from different controllers may be avoided. The transmissions may also include leader information at the beginning of each transmission to identify at least the transmitting controller.

In one aspect of the present invention, some embodiments of an interactive system may comprise at least two controllers that communicate with each other to provide a method of controlling the operation of an HVAC system, based on a communication protocol utilized by each of the various controllers. The communication protocol provides for establishing communication between a sending controller and at least one other controller that is the intended recipient. The communication protocol also provides for monitoring of communication signals by one or more controllers in the system, where the one or more controllers monitor communication signals which are intended for other recipient controllers to thereby listen to information being communicated such that each control may interactively respond to information relevant its own operation within the HVAC system. This communication protocol provides for checks and balances in the communication of relevant information between the various controllers, to enable individual controllers to interactively control the operation of the HVAC system. This communication protocol provides the guidelines by which the various controllers may transmit and receive communication signals, and interact with each other in an effective manner for controlling the HVAC system. One example of such a communication protocol is the "Climate Talk" protocol developed by White-Rodgers, a Division of Emerson Electric, which is hereby incorporated in its entirety below. Various advantages of the "Climate Talk" communication protocol will become apparent from the several aspects regarding HVAC control disclosed within the protocol itself.

A copy of the "Climate Talk" protocol (tables, etc.) is included in Appendix I, which is considered to be part of this application, and is incorporated herein by reference.

One aspect of the climate talk protocol, as disclosed in section 5.4.7.2 and FIG. 5 and of Appendix I, provides for implementation of an HVAC RS-485 network circuit, for connecting a number of communicating controllers or devices thereto Another aspect of the climate talk protocol, as disclosed in section 5.5 and FIG. 9 of Appendix I, provides for a message packet structure for messages communicated between a number of communicating controllers or devices.

Another aspect of the climate talk protocol, as disclosed in section 5.8 and Table 5 of Appendix I, provides for categorization of message types within the context of the RS 485 network itself.

Another aspect of the climate talk protocol, as disclosed in sections 5.8.5.1.1.10, 5.8.5.1.1.12, 5.8.5.1.1.13, 5.8.5.1.1.14, and 5.8.5.1.1.15 of Appendix I, provides for categorization of message types within the context of the HVAC system functions, such as dehumidification, heat, cool, fan control, and defrost control.

Another aspect of the climate talk protocol, as disclosed in section 5.8.14 and Table 19 of Appendix I, provides for identification within the message packet of the Node type of the sending controller. The node type information in the message packet may be employed by other controllers as the basis for determining which messages to listen to or monitor.

Another aspect of the climate talk protocol, as disclosed in section 7.3.2.1 of Appendix I, provides for message packet structure that includes the source and destination addresses, and source node type.

Another aspect of the climate talk protocol, as disclosed in section 7.3.2.6.1 of Appendix I, provides for message type designations. The message type information in the message packet may be employed by other controllers as the basis for determining which messages to listen to or monitor.

For example, an interactive HVAC system may comprise controllers that include a microprocessor capable of transmitting one or more unique data signals through a UART interface. The microprocessor is configured to communicate a valid start bit followed by subsequent data bits of a signal to be transmitted via the power lines. Referring to the Message Configuration Table below, the serial data signal includes one or more data bits, the first data bit of which comprises a destination node or address that the serial data signal is intended to be received at. The serial data signal further comprises a subsequent data bit that includes the sender's node or address, and may further include a subnet node or address. The data signal may further comprise a node type data bit and device request data bit, which may permit a controller (such as a thermostat) to take control of the communication transmissions being sent over the two-wire "bus" network lines.

TABLE

Message Configuration

| Addressing | | | 3rd Party | | Special | Function | Messages | | | CRC |
|---|---|---|---|---|---|---|---|---|---|---|
| Byte 0 | Byte 1 | Byte 2 | Byte 3 | Byte 4 | | Byte 5 | Byte 6 | Byte 7 | Bytes 8-(N – 2) | Bytes N |
| Destination Node Address | Sender Address | Subnet | Node Type | Device Request | Payload Config | Message Type | Packet Number | Payload Length | Data Payload | Checksum |
| 8 Bits | 8 Bits | 8 Bits | 8 Bits | 4 Bits | 4 Bits | 8 Bits | 1 Byte | 1 Byte | 1 to 245 bytes | 2 Bytes |
| (0-255) | (1-255) | (0-255) | (0-255) | (0-15) | (0-15) | (0-255) | (0-255) | (0-245) | (1-N) | (0-65535) |

The serial data signal transmitted by the controllers comprises a node type data bit, which permits controllers that are capable of a listen mode to monitor signals transmitted by other controllers, such that one or more listening controllers may modify the operation of their respective HVAC components in response to operating information signals transmitted by other controllers. For example, if an outdoor compressor unit controller communicates a signal indicating that the compressor has been restricted to low capacity operation, the indoor air handler unit controller listening to the signal could respond to the operating information by modifying operating of the circulator blower to a reduced speed that corresponds with the low capacity compressor operation. Node types could include controllers for any of the following number of HVAC components or subsystems listed in the Node Table below.

TABLE

Node Types

| Node Type | Node ID |
|---|---|
| Thermostat | 0 |
| Gas Furnace | 1 |
| Air Handler | 2 |
| Unitary Air Conditioner | 3 |
| Unitary Heat Pump | 4 |
| Electric Furnace | 5 |
| Package System | 6 |

TABLE-continued

Node Types

| Node Type | Node ID |
|---|---|
| (Gas) | |
| Packager System (Electric) | 7 |
| Ceiling fan | 8 |
| Whole house fan | 9 |
| Air Exchanger | 10 |
| Dehumidifier | 11 |
| Electronic Air Cleaner | 12 |
| ERV | 13 |
| Humidifier (Evap) | 14 |
| Humidifier (Steam) | 15 |
| HRV | 16 |
| IAQ Analyzer | 17 |
| Media Air Cleaner | 18 |
| Zone control | 19 |
| Zone master | 20 |

TABLE-continued

Node Types

| Node Type | Node ID |
|---|---|
| UV Light | 21 |
| Boiler | 22 |
| Gas Water Heater | 23 |
| Electric Water Heater | 24 |
| Commercial Water Heater | 25 |
| Pool Heater | 26 |
| Bus Interface Module | 27 |
| Gateway | 28 |
| Diagnostic Device | 29 |
| Lighting Control | 30 |
| Security System | 31 |
| Fuel cell | 32 |
| Spare | 33-255 |

In one or more embodiments, the controllers are capable of monitoring the two-wire "bus" network lines for transmission signals, and are capable of listening to data signals from various transmission sources that are intended for a different destination address (or controller). While a signal may be intended for a given destination address, other controllers may still "listen" to or receive these signals and analyze them depending on the node type of the sender of the signal. The listening mode of the controllers provides for sharing information that reduces the number of signal transmissions by eliminating request signals for information, and also provides for improved diagnostic capability, component safety, fault protection, and occupant safety.

For example, a transmitted signal may includes a source address and node type of a controller for an outdoor air conditioner compressor unit (eg—unitary air conditioner node ID 3) and a destination address of the thermostat, and may communicate diagnostic information of a high Discharge Line Temperature (DLT) upon start up of the compressor, indicating a possible low refrigerant charge that may require servicing. A controller for the indoor air handler may listen to the message from the compressor unit node type, and responsively compare the sensed temperature difference across the indoor A-coil to a predetermined delta to evaluate whether the difference is out of range, which would confirm that the refrigerant charge is low. The indoor air handler controller could then communicate a confirmation of a low refrigerant charge to the thermostat controller, to prompt the thermostat to alert the occupant of the need for servicing of the low charge condition.

In another example, a thermostat controller could transmit a signal to a controller for a compressor of an air conditioning or heat pump system to request operation of the compressor. The controller of the air handler's circulating air blower could "listen" to or receive the signal and responsively check its line voltage level sensing circuitry associated with a variable speed inverter driver for a blower motor, to verify that the line voltage level is not below a threshold value indicative of a brown out condition. If the circulating air blower controller determines that a low line voltage condition exists, the circulating air blower controller could transmit a signal including the low line voltage information to the compressor controller, which could responsively discontinue operation to protect the compressor from being damaged by the low voltage condition. This type of interactive communication can accordingly provide component protection against damage for one of more components in the climate control system.

In another example, occupant safety is provided in a situation of a presence of an unsafe level of carbon monoxide. In a climate control system that at least includes a fuel-fired heating system and a thermostat controller in connection with a common and two-wire "bus" network lines, the system may further include a fuel-fired water heater in connection with the two-wire "bus" network lines. A controller for the fuel fired water heater is connected to the two-wire "bus" network lines and is capable of receiving and transmitting signals superimposed onto the low frequency low-voltage waveform. The fuel-fired heating system controller is capable of modifying the operating of the heating system by shutting down, in response to "listening" to a signal transmitted by the water heater controller that is intended for the thermostat controller, which includes information about the presence of a harmful level of carbon gas or a presence of flammable vapors. In either case, the furnace or heating system would discontinue operation to help improve the safety of the occupants. Likewise, a carbon monoxide detector could also be configured to provide an indication of a harmful carbon monoxide level which may be communicated through a high frequency signal superimposed onto the low frequency low-voltage waveform to alert the thermostat controller. The heating system controller would be capable of "listening" to or receiving the signal intended for the thermostat which includes information about a harmful carbon monoxide level, and responsively discontinues operation of the heating system.

The usage of node types is one way of receiving data from other devices one the network without having to initiate a request signal for information. The various controllers or subsystem devices can operate in a listen mode to monitor signals transmitted by certain node types to get information from certain subsystem devices or controllers. Alternatively, the controllers can also request transmission of information from other controllers. In order to determine what can be requested from other controllers that are in communication via the two-wire "bus" network, a controller device may transmit a device request to query what types of devices are present.

The serial data signal transmitted by the controllers may further comprise a payload data configuration byte, as disclosed in the Climate Talk protocol of Appendix I. The payload configuration bits are used in determining what type of data packet is being received. These bits are located in byte 3 of every data packet sent in bits 0-3. The message type is contained in Byte 5 of the packet, and may provide information as to whether the signal is interrogating or requesting information from another controller or a component, whether the signal is of a sensor data type, whether the signal is a unique command signal intended for a specific controller or component in the system, or whether the signal is an operating informational message intended for a specific controller in the system, such as a thermostat. The message may be a code which other controllers may recognize. The message may also be a text message, as opposed to a fixed-digit code that the thermostat must look up to display a corresponding message to an occupant. In this manner, a controller may provide more specific repair or maintenance information than just a code. The Message Type Table below outlines some of the message types that may be employed in the various embodiments. It should be noted that any one of a number of controllers communicating via the network may prompt the thermostat to display a variable length text message, as indicated in message type 20. This feature allows for thermostat compatibility with newer version controllers that may be installed or upgraded at a future point in time. Such new controllers could simply send asci-text messages with detailed diagnostic information to the thermostat, rather than send a diagnostic code number that may not be recognized.

TABLE

Message Type.

| Message Type | Message Name | Description |
|---|---|---|
| 0 | Ready | Used to make normally subordinates a coordinator |
| 1 | Status Request | Used to request operating status of a controller or its |
| 2 | Status Reply | respective components |
| 3 | Control Command | Commands a specific controller/component to operate in a desired mode |
| 4 | Configuration Request | Installation Parameter Info used to configure controllers and |
| 5 | Configuration Data | components |

TABLE-continued

| Message Type | Message Name | Description |
|---|---|---|
| | | Message Type. |
| 6 | Sensor Read Request | Serial communication by any external/Internal sensors in a subsystem that can be shared with the system |
| 7 | Sensor Data | |
| 8 | Spare | |
| 9 | Set Address | |
| 10 | Event Request | Request Data defined as historical operating information of a specific controller or component in the system. |
| 11 | Event Reply | |
| 12 | ID Request | Identification Data of individual controllers and components in the system |
| 13 | ID Set | |
| 14 | ID Reply | |
| 15 | Node Type Request | |
| 16 | Node Type Reply | |
| 17 | Message Config Request | Used to determine which messages are applicable per specific component or controller in the system. |
| 18 | Message Config Reply | |
| 19 | Display Control Request | Used to take control of the thermostat display to provide installation/diagnostic/System Checks or any other subsystems needs. (text message may vary in length) |
| 20 | Display Control Reply | |
| 21 | Shared Device Data Request | Installation Specific Configuration Data used for transmitting data to shared networks or external network |

Accordingly, the one or more controllers may transmit a text messages to a thermostat controller to alert an occupant of specific maintenance requirements, such as a dirty air cleaner in need of filter replacement, or an outdoor compressor with a low refrigerant charge.

Another aspect of the climate talk protocol, as disclosed in section 7.3.1.3 of Appendix I, provides for staggered transmission by different controllers, which may be accomplished by using an inter-packet delay, for example. As stated above, transmitted packets are separated by an interpacket delay, which should be at least 100 mSec. Each individual controller is configured to transmit at a fixed time period after the last transmission, where each controller may have a fixed time period that is unique to that controller. Thus, after one controller completes its transmission, another controller will wait for the interpacket delay period and its associated time period before transmitting packet information. In this manner, collisions of data transmission from different controllers may be avoided.

Another aspect of the climate talk protocol, as disclosed in section 8.3.1.2, and 8.3.1.2.2 of Appendix I, provides for shared configuring data. For example, configuring data may include the capacity or size data of the outdoor compressor/condenser unit of an HVAC system (3 ton unit, for example), which may be stored by a thermostat controller, indoor air circulator blower controller, and an outdoor compressor/condenser fan controller. Another aspect of the climate talk protocol, as disclosed in section 9.1.3 of Appendix I, provides for message types for Air Handlers, and parameters for blower motors. The message type information in the message packet may be communicated to a motor controller to provide the parameters or command specific to the motor that are necessary for the motor controller to run the blower. A given controller may lose stored configuring data or ceases to operate due to power interruption or power spike, for example, Upon restoration of power or replacement of the non-operating controller, the unconfigured controller may receive such configuration data from the other controllers through a data request, so that the controller may automatically be configured with this system-specific data.

Another aspect of the climate talk protocol, as disclosed in section 8.4.1.2.1.1 of Appendix I, provides for incremental installation of new controllers or equipment to the network, where the thermostat may initiate a restart due to changes in the network that the thermostat has detected. For example, in section 8.4.1.2.1.1 of Appendix I, if there was a call for heat to the furnace, but a heat pump was installed on the network bus, the thermostat would instruct subsystem controllers to go into an idle mode. Accordingly, the thermostat may control the network for new installation of controllers, and re-configure its collection of system nodes or controllers in the HVAC network.

For example, one implementation of an interactive system having two or more controllers provides for incrementally installing and connecting new controllers to the network. Such new controllers may be configured without requiring the installation of a master thermostat for controlling communication between the controllers. As an illustration, a homeowner may decide to install a second air conditioning system for a second floor of a home that has an existing air conditioning system including interactive controllers and a thermostat controller in connection with a network. The existing controllers communicate to an existing interactive thermostat controller, which may further be used to control the new second floor air conditioning system controllers. The new controllers for the new air conditioning components and a new temperature sensor associated with the new controllers (for the second floor) are preferably connected to the network. The new temperature sensor subsequently sends signals including temperature information, and the new controllers also send status signals, via the network. Such signals may be addressed to a default thermostat type. The existing thermostat controller would be capable of listening to the signals transmitted by the temperature sensor and the new controllers, regardless of whether the signal is addressed to or intended for the existing thermostat. Upon monitoring a signal from the new controllers and the new temperature sensor, the existing thermostat controller could responsively communicate a signal to the new controllers to modify the operation of the second system, eg. to activate the system. The existing thermostat controller can then monitor the signals transmitted by the new temperature sensor to determine whether the temperature is decreasing in response to its request of the new controllers to establish operation of the second cooling system. Thus, the existing thermostat controller is interactively capable of associating the new controllers and the new temperature sensor, and subsequently controlling the new second air conditioning system via the network.

Additionally, the climate talk protocol as disclosed in section 8.4.1.2.4.1 of Appendix I, also provides for commissioning of individual controllers that are installed and connected to the bus. For example, a zone damper control and zone temperature sensor may be installed, and automatically commissioned by the thermostat.

For example, the thermostat controller may identify newly installed controllers by communicating a query request to the network of all devices on the network, which devices may reply by broadcasting identifying information that may include a device code identifying what the device on the network is, and an assignment code if any is associated with the new controller. Once the newly installed "unassigned" remote temperature sensor and damper control device are unassigned have been identified, the thermostat will begin an automatic self configuration of the system, and will designate or assign the temperature sensor to the thermostat upon heating or cooling operation that causes a temperature change sensed by the remote sensor corresponding to the operation of the associated zone damper. In this manner, the thermostat can verify an association between the operating open or closed states of a particular zone damper and the remote temperature sensor, during either heating or cooling operation.

In another aspect of the present disclosure, some embodiments include one or more interactive controllers for a climate control system, where at least one controller is capable of modifying the operation of one or more system components under its control in response to receiving a signal transmitted by another controller that includes information about the operation of at least one component or controller in the climate control. The system may comprise at least two controllers for controlling the operation of one or more components of the cooling system. The at least two controllers can communicate via the two-wire "bus" network lines to provide for operation in either a full capacity mode of operation or a reduced capacity mode of operation, based on the communication by one of the at least two controllers of information relating to the operation or condition of a component under the individual controller's control. For example, if the thermostat controller transmits a signal requesting compressor operation and the indoor air handler/circulating air blower controller is not capable of operating, the indoor air handler controller may detect the blower operation failure (by a pressure sensor, motor current sensor, or temperature sensor for example) and transmit a signal via the two-wire "bus" network lines communicating the failure to another controller. The signal may be intended for a specific controller, such as the thermostat controller or the compressor unit controller. Where the signal is intended for the compressor unit controller, the compressor unit controller could respond to the information of a blower failure by modifying its operation to shut down the compressor to protect the compressor motor from possible damage due to the indoor coil unit freezing up. The compressor unit controller would shut down even though the thermostat controller is still requesting operation of the compressor. Where the signal includes an address or intended destination of a thermostat controller, the compressor unit controller may still "listen" to the signal intended for the thermostat controller, and responsively shut down the compressor to protect the compressor. The compressor unit controller could subsequently transmit a signal via the two-wire "bus" network lines that is addressed to the thermostat controller, for communicating the shut down of the compressor due to the information on the failed circulator blower, such that the thermostat controller may alert the occupant of a need for service.

In yet another aspect, some embodiments of an interactive system may comprise at least two controllers that communicate information via the two-wire "bus" network lines to provide for controlling operation of one or more system components in either a full capacity mode or a reduced capacity mode of operation based on the communication of information relating to the operation of one of the at least two controllers. For example, an interactive system may comprise at least two controllers that together provide for controlling the operation of a multi-stage air conditioning system in either a high capacity or a low capacity mode. If a first compressor unit controller is not able to continuously operate the compressor in high capacity mode (due to a high discharge line temperature, or high motor current for example), the compressor unit controller could restrict operation to low capacity mode and transmit a signal via the two-wire "bus" network lines communicating the restriction. The signal may be intended for the second controller for an air handler circulating air blower, or for the thermostat controller. Where the signal is intended for the circulating air blower controller, the circulating air blower controller could receive the signal and responsively reduce the circulator blower speed to correspond to the low capacity compressor mode of operation to allow the air conditioning system to operate in a limp-along mode until the air conditioning system can be serviced. The compressor and circulating air blower would be operated at a low capacity mode even though the thermostat controller is still requesting operation at high capacity. Where the signal includes an address or intended destination of a thermostat controller, the circulating air blower controller may still "listen" to the signal intended for the thermostat controller, and responsively reduce the circulator blower speed to correspond to the low capacity compressor operation mode.

Moreover, in the above example of a second air conditioning system installation, the existing thermostat controller may be configured to detect the new components via the network and alert the user of the detection of a second air conditioning system. The existing thermostat controller can allow user of the thermostat to then enter a set-point temperature for each air conditioning system, each of which will control operation of their respective air conditioning system. Thus, the user may control the operation of the new controllers in the second system without knowing their specific node types or addresses. The existing thermostat controller may optionally, but not necessarily, identify each of the new controllers associated with the second air conditioning system as a sub-node type. The existing thermostat controller may simply assign a node type for each of the new controllers within an internal memory of the thermostat. The thermostat optionally may communicate a signal including a sub-node identification to each of the new controllers that the existing thermostat controller has associated with a new temperature sensor for example. By identifying the new controllers as a particular sub-node type, the existing thermostat controller can then display to the user the sub-node type associated with the new second air conditioning system. A user or a service repairman would then be able to distinguish newly installed controllers of the second system by the displayed sub-node type, such that the user or repairman can select a particular controller within the second air conditioning system to request operational or diagnostic information pertaining to the second air conditioning system (as opposed to information pertaining to the existing air conditioning system). The existing thermostat, by at least internally assigning a sub-node type to the second system controllers (but not necessarily assigning a sub-node address to the individual controllers), would allow the thermostat to function as a user-interface that would allow the user to gain access to the new controllers of the second air conditioning system without having to know their respective addresses or node types. This exemplary system is notably different from "master-slave" thermostat situation, which would not permit the new controllers to communicate via the network to other controllers until each new controller is manually set-up or configured through the master thermostat.

In the above exemplary embodiment, the existing thermostat controller may also be used as an interface to gain access to the new controllers of the second air conditioning system for modifying their default settings, without having to know their respective addresses or node types. While each of the new controllers of the second air conditioning system may each be modified from their default operating configuration by manually accessing each control at its respective location, the new controllers may also be communicated to via the network through a thermostat controller in connection with the network. For example, a controller for an indoor air handler associated with the second air conditioning system may have a default time delay period in which the circulator blower remains on after discontinuation of compressor operation, which time period may be altered by a user. Rather than the user having to go the location of the specific controller and manually entering a setting (by pressing a button on the thermostat controller a certain number of times, for example), the user may prompt the thermostat to display the settings of a selected controller. The user may then modify or select a different setting, which the thermostat controller would then communicate via the network to the selected controller such that the controller may change its default setting.

The various embodiments provide for one or more controllers in connection with a communication network for enabling transmission of signals addressed to or intended for a specific controller. While each signal may be intended for a specific controller, at least one controller may listen to signals intended for other controllers and may modify the operation of at least one component that the at least one controller has control over in response to receiving a signal that is intended for another controller which includes information about the operation of a component within the system. The controllers in the various embodiments are capable of providing cooling or heating operation in a "limp along" mode, while alerting the occupant of service or repair needs via a text message before the system becomes inoperable. The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A system including interactive controllers for controlling the operation of a climate control system, the interactive system comprising:

a two-wire peer-to-peer network for permitting communication between one or more controllers;

a thermostat controller, a controller for controlling an outdoor compressor unit in the HVAC system, a controller for controlling an air circulation blower unit in a climate control system, and a controller for controlling a blower motor that is installed in the climate control system, the controllers being connected to each other only through each controller's individual connection to the two-wire peer-to-peer network, wherein the controller for controlling a blower motor is configured to transmit, via the two-wire network, serial data signals comprising configuration data that include parameters specific to the particular blower motor installed in the climate control system that are necessary for the motor controller to run the blower motor;

wherein at least one of the thermostat controller, the controller for controlling an outdoor compressor unit and the controller for controlling an air circulation blower unit is configured to receive and store the configuration data that includes parameters specific to the particular blower motor, and wherein the controller for controlling a blower motor is configured to receive via communication of a data request the configuration data from at least one of the thermostat controller, the controller for controlling an outdoor compressor unit or the controller for controlling an air circulation blower unit, whereby upon replacement of the blower motor controller, the replacement may receive the configuration data from at least one of the thermostat controller, the controller for controlling an outdoor compressor unit or the controller for controlling an air circulation blower unit.

* * * * *